US011053068B1

(12) United States Patent
Chen

(10) Patent No.: US 11,053,068 B1
(45) Date of Patent: Jul. 6, 2021

(54) AEROSOL SPRAY CAN

(71) Applicant: MOTEDO CO., LTD., Taipei (TW)

(72) Inventor: Han-Liang Chen, Taipei (TW)

(73) Assignee: Motedo Co., Ltd., Taipei (TW)

( * ) Notice: Subject to any disclaimer, the term of this patent is extended or adjusted under 35 U.S.C. 154(b) by 0 days.

(21) Appl. No.: 17/005,581

(22) Filed: Aug. 28, 2020

(30) Foreign Application Priority Data

Mar. 31, 2020 (TW) ..... 109111066

(51) Int. Cl.
*B65D 83/32* (2006.01)
*B05B 11/00* (2006.01)

(52) U.S. Cl.
CPC ..... *B65D 83/32* (2013.01); *B05B 11/0008* (2013.01); *B05B 11/0037* (2013.01); *B05B 11/0089* (2013.01)

(58) Field of Classification Search
CPC . B65D 83/32; B05B 11/0008; B05B 11/0089; B05B 11/0037
See application file for complete search history.

(56) References Cited

U.S. PATENT DOCUMENTS 3,575,323 A * 4/1971 Steinman ..... B65D 83/46 222/402.21
3,667,655 A * 6/1972 Knieriem, Jr. ..... B65D 83/32 222/464.4
5,839,620 A * 11/1998 Battegazzore ..... B05B 11/0059 222/382
6,779,693 B2 * 8/2004 Sweeton ..... B05B 11/0044 222/464.4
6,833,072 B1 * 12/2004 Krestine ..... B01D 35/027 210/416.1
9,051,166 B2 * 6/2015 Finlay ..... B67D 1/0456
2004/0089674 A1 * 5/2004 Harrity ..... F16L 33/035 222/464.4
2007/0210122 A1 * 9/2007 Giovannoni ..... B05B 15/33 222/464.4
2010/0140303 A1 * 6/2010 Baglin ..... B05B 11/0059 222/464.4

(Continued)

FOREIGN PATENT DOCUMENTS

CN 107187722 A 9/2017
DE 4447087 A1 * 7/1996 ..... B65D 83/36

(Continued)

*Primary Examiner* — Frederick C Nicolas
(74) *Attorney, Agent, or Firm* — Rosenberg, Klein & Lee

(57) ABSTRACT

An aerosol spray can has a can body, a valve assembly, a dip-tube assembly and a rigid tube. The valve assembly is mounted on the can body. The dip-tube assembly is connected to the valve assembly and has a head end channel-linked to the valve assembly. The dip-tube assembly has a flexible tube and a weight piece. The two ends of the flexible tube are connected to the valve assembly and the weight piece respectively. The rigid tube is sleeved around the flexible tube to constrain excessive bending of the flexible tube. The flexible tube protrudes from the rigid tube. The weight of the weight piece drives the tail end freely toward the ground. Therefore, the tail end stays submerged under a liquid product when less than a half of the liquid product is left inside the can body even when the can body is tilted or horizontal.

16 Claims, 18 Drawing Sheets

(56) References Cited

U.S. PATENT DOCUMENTS

| | | | | |
|---|---|---|---|---|
| 2010/0243761 | A1* | 9/2010 | Gosis | B65D 83/32<br>239/372 |
| 2012/0234862 | A1* | 9/2012 | Kharbanda | B65D 83/32<br>222/173 |
| 2015/0217314 | A1* | 8/2015 | Kharbanda | A47K 5/1201<br>222/1 |

FOREIGN PATENT DOCUMENTS

| | | | | | |
|---|---|---|---|---|---|
| JP | 06345163 | A | * | 12/1994 | B65D 83/32 |
| JP | 07069387 | A | * | 3/1995 | B65D 83/32 |
| JP | 07096982 | A | * | 4/1995 | B65D 83/32 |
| JP | 08040473 | A | * | 2/1996 | B65D 83/32 |
| JP | 10324378 | A | * | 12/1998 | B65D 83/32 |
| JP | 2004267627 | A | * | 9/2004 | B65D 83/754 |
| TW | M537628 | U | | 3/2017 | |

* cited by examiner

AEROSOL SPRAY CAN

BACKGROUND OF THE INVENTION

1. Field of the Invention

The present invention relates to a container that is used for containing and spraying a liquid product, especially to an aerosol spray can that can be filled with a liquid product and propellant. The liquid product can be driven out from the aerosol spray can by the propellant to spray out the liquid.

2. Description of the Prior Arts

With reference to FIGS. 9 and 10, a conventional aerosol spray can used for spraying liquid products, such as a bug spray or a pepper spray, includes a can body 91, a valve assembly 92, a dip tube 93 and an actuator 94. A crimping opening is formed on a top of the can body 91. The valve assembly 92 is fixed to the can body 91 and seals the crimping opening. The dip tube 93 is mounted in the can body 91. A head end 931 of the dip tube 93 connected to the valve assembly 92. A tail end 932 of the dip tube 93 is adjacent to a bottom of the can body 91.

When the aerosol spray can is in use, propellant and liquid product A are filled into the can body 91. The pressure formed by the propellant drives the liquid product A to enter the dip tube 93, and then the liquid product is sprayed from the aerosol spray can via the valve assembly 92 and the actuator 94.

There are two major types of dip tubes 93:

Firstly, the dip tube 93 with the tail end 932 located near a corner 911, where a side wall of the can body 91 and the bottom of the can body 91 are connected. The actuator 94 is generally fixed on a top of the aerosol spray can. The head end 931 of dip tube 93 is mounted to a bottom end of the valve assembly 92. The dip tube 93 is slightly curved such that the tail end 932 is curved toward a same direction as a spraying opening 941 of the actuator 94 faces towards. A liquid intake on the tail end 932 is located near the corner 911 to ensure the liquid intake is submerged and located in the liquid product A, which is located in the bottom of the can body 91.

The liquid intake on the tail end 932 is submerged in the liquid product A when the aerosol spray can is operated in an upright position. The liquid intake remains submerged in the liquid product A when the aerosol spray can is tilted or horizontal while less than a half of the liquid product A is left in the can body 91. The liquid product A in the can body 91 is sprayed by pressing down the actuator 94 in said positions.

With reference to FIGS. 11 and 12, however, when the liquid product A is less than a half in the aerosol can, and the aerosol spray can is operated in a horizontal position with the spraying opening 941 facing upward, or when the aerosol spray can is in a down tilted position and with any horizontal rotating action to cause the spraying opening 941 not facing downward, the tail end 932 of the dip tube 93 moves together with the can body 91 and no longer remains submerged in the liquid product A. Furthermore, because the can body 91 is often made from opaque materials, a user cannot see the position of the tail end 932. Therefore, the liquid product A in the can body 91 cannot be sprayed by pressing down the actuator 94 in said positions even if there is liquid product A left in the can body 91.

Secondly, straight dip tube. With reference to FIG. 13, the head end 931A of the straight dip tube 93A is often mounted to the bottom end of the valve assembly 92A. The tail end 932A of the dip tube 93A extends in the middle of the can body and the liquid intake on the tail end 932A is adjacent to the bottom of the can body. The liquid intake on the tail end 932 is submerged in the liquid product A when the aerosol spray can is operated in an upright position. The liquid product A can be sprayed by pressing down the actuator 94A.

With reference to FIGS. 14 to 16, however, when the aerosol spray can is operated in a horizontal position with the spraying opening 941A facing downward, or when the aerosol spray can is down tilted in a way that the spraying opening 941A faces downward, the liquid intake of the dip tube 93A no longer remains submerged in the liquid product A. Therefore, the liquid product A cannot be sprayed by pressing down the actuator 94A or by pulling the trigger 971 of the spraying gun 97 even if there is still liquid product A left in the aerosol spray can.

To overcome the shortcomings, the present invention provides an aerosol spray can to mitigate or obviate the aforementioned problems.

SUMMARY OF THE INVENTION

The main objective of the present invention is to provide an aerosol spray can which has a tail end of a dip-tube assembly automatically to be driven toward the ground due to gravity and weight. Therefore, when the aerosol spray can is tilted in any direction or is horizontal, or when less than a half of liquid product A is left in the aerosol spray can, the tail end stays submerged in the liquid product A and is able to spray the liquid product A from a can body of the aerosol spray can.

The aerosol spray can has a can body, a valve assembly, a dip-tube assembly and a rigid tube. The can body is hollow and has a mounting opening. The valve assembly is fixed to the mounting opening and seals the mounting opening. The valve assembly has a liquid product intake and a liquid product outlet. The liquid product intake is located in an inner space of the can body. The liquid product outlet is located outside of the can body. The liquid product intake is selectively channel-linked to the liquid product outlet. The dip-tube assembly has a head end linked to a tail end, and said head end is channel-linked to the liquid product intake of the valve assembly, and said tail end extends toward a bottom of the can body. The dip-tube assembly has a flexible tube and a weight piece. Two opposite ends of the flexible tube are a valve end and a weight end respectively. The valve end is channel-linked to the liquid product intake of the valve assembly. The weight end extends toward the bottom of the can body. The weight piece is mounted to the weight end of the flexible tube. The weight piece has a weight ring and a buffer shell. The buffer shell is wrapped around the weight ring. When the can body is tilted, the tail end of the dip-tube assembly is driven by the weight piece and moved toward the ground automatically. The rigid tube has a top end and a bottom end. The top end of the rigid tube is connected to the valve assembly, and the bottom end of the rigid tube extends toward the bottom of the can body. The rigid tube is sleeved around the flexible tube, and the weight end of the flexible tube extends from the bottom end of the rigid tube. The flexible tube has an exposed section extending from the bottom end of the rigid tube. The exposed section is located between the bottom end of the rigid tube and a top of the weight piece.

The aerosol spray can has a can body, a valve assembly, a dip-tube assembly and a rigid tube. The can body is hollow and has a mounting opening. The valve assembly is fixed to the mounting opening and seals the mounting opening. The valve assembly has a liquid product intake and a liquid product outlet. The liquid product intake is located in an inner space of the can body. The liquid product outlet is located outside of the can body. The liquid product intake is selectively channel-linked to the liquid product outlet. The dip-tube assembly has a head end linked to a tail end, and said head end is channel-linked to the liquid product intake of the valve assembly, and said tail end extends toward a bottom of the can body. The dip-tube assembly has a flexible tube, a weight-fixing bushing plug, and a weight piece. Two opposite ends of the flexible tube are a valve end and a weight end respectively. The valve end is channel-linked to the liquid product intake of the valve assembly. The weight end extends toward the bottom of the can body. The weight-fixing bushing plug is annular to form a weight-fixing hole. The weight-fixing hole is slipped onto the weight end of the flexible tube such that the flexible tube is fixed through the weight-fixing hole. Two opposite openings of the weight-fixing hole are respectively a first bushing opening and a second bushing opening. The weight-fixing bushing plug has a slot formed through an annular wall of the weight-fixing bushing plug. The slot extends to the second bushing opening of the weight-fixing bushing plug to enhance elastic expansion of the second bushing opening. The weight piece is mounted to the weight end of the flexible tube. When the can body is tilted, the tail end of the dip-tube assembly is driven by the weight piece and moved toward the ground automatically. The rigid tube has a top end and a bottom end. The top end of the rigid tube is connected to the valve assembly, and the bottom end of the rigid tube extends toward the bottom of the can body. The rigid tube is sleeved around the flexible tube, and the weight end of the flexible tube extends from the bottom end of the rigid tube. The flexible tube has an exposed section extending from the bottom end of the rigid tube. The exposed section is located between the bottom end of the rigid tube and a top of the weight piece.

The aerosol spray can has a can body, a valve assembly, a dip-tube assembly and a rigid tube. The can body is hollow and has a mounting opening. The valve assembly is fixed to the mounting opening and seals the mounting opening. The valve assembly has a liquid product intake and a liquid product outlet. The liquid product intake is located in an inner space of the can body. The liquid product outlet is located outside of the can body. The liquid product intake is selectively channel-linked to the liquid product outlet. The dip-tube assembly has a head end linked to a tail end, and said head end is channel-linked to the liquid product intake of the valve assembly, and said tail end extends toward a bottom of the can body. The dip-tube assembly has a flexible tube, a valve-fixing bushing plug, and a weight piece. Two opposite ends of the flexible tube are a valve end and a weight end respectively. The valve end is channel-linked to the liquid product intake of the valve assembly. The weight end extends toward the bottom of the can body. The valve-fixing bushing plug has a valve-fixing hole. The valve-fixing hole is slipped on and around the valve end of the flexible tube such that the flexible tube is tightly fixed through the valve-fixing hole. The weight piece is mounted to the weight end of the flexible tube. When the can body is tilted, the tail end of the dip-tube assembly is driven by the weight piece and moved toward the ground automatically. The rigid tube has a top end and a bottom end. The top end of the rigid tube is connected to the valve assembly, and the bottom end of the rigid tube extends toward the bottom of the can body. The rigid tube is sleeved around the flexible tube, and the weight end of the flexible tube extends from the bottom end of the rigid tube. The flexible tube has an exposed section extending from the bottom end of the rigid tube. The exposed section is located between the bottom end of the rigid tube and a top of the weight piece.

The advantages of the present invention are as follows:

Firstly, the weight piece is mounted to the weight end of the flexible tube, and therefore located at the tail end of the dip-tube assembly. When the can body is tilted or horizontal, the weight piece is subjected to gravity, which drives the tail end of the flexible tube of the dip-tube assembly to move toward the ground automatically. As a result, the tail end moves and a liquid product inside the can body also moves to a same direction. Even if the liquid product flows from the bottom of the can body to a side wall of the can body, the tail end of the flexible tube will automatically move toward a position where the liquid product stays, thereby ensuring that the tail end stays submerged in the liquid product and is able to spray the liquid product even when the aerosol spray can is tilted or horizontal while only less than a half of the liquid product is left in the can body.

Secondly, the rigid tube is partially sleeved around the flexible tube, the bending of the flexible tube is properly constrained by the rigid tube to prevent the flexible tube from unintended tangling or inverting due to the effects of high-pressure propellant inside the can body or drastic shaking by a user. The dip-tube assembly keeps the tail end submerged in the liquid product and keep the liquid product being sprayed out normally.

Thirdly, by adopting a flexible tube and mounting a weight piece to the bottom of the flexible tube, and mounting the flexible tube through the rigid tube, and having an exposed section, which is adequately flexible and moderately stretchable, located between the top of the weight piece and the bottom of the rigid tube, the weight piece which pulls the flexible tube downward can agilely move the tail end toward the liquid product and submerge the tail end in the liquid product regardless that the can body is in an upright position, a horizontal position or any tilted position with rotation action and when the liquid product is less than a half left in the can body. Additionally, the present invention can be used with large-volume cans (cans with 1-inch valves for example) or small-volume cans (cans with 20-millimeter valves for example). In summary, the present invention can eject nearly all liquid product inside the can body, thereby reducing waste of resources due to excessive liquid product that cannot be optimally utilized and is thus left in the can body. These are the advantages that the conventional dip tubes (straight dip tubes and dip tubes with the tail end located near a corner, where a side wall of the can body and the bottom of the can body are connected) do not have.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
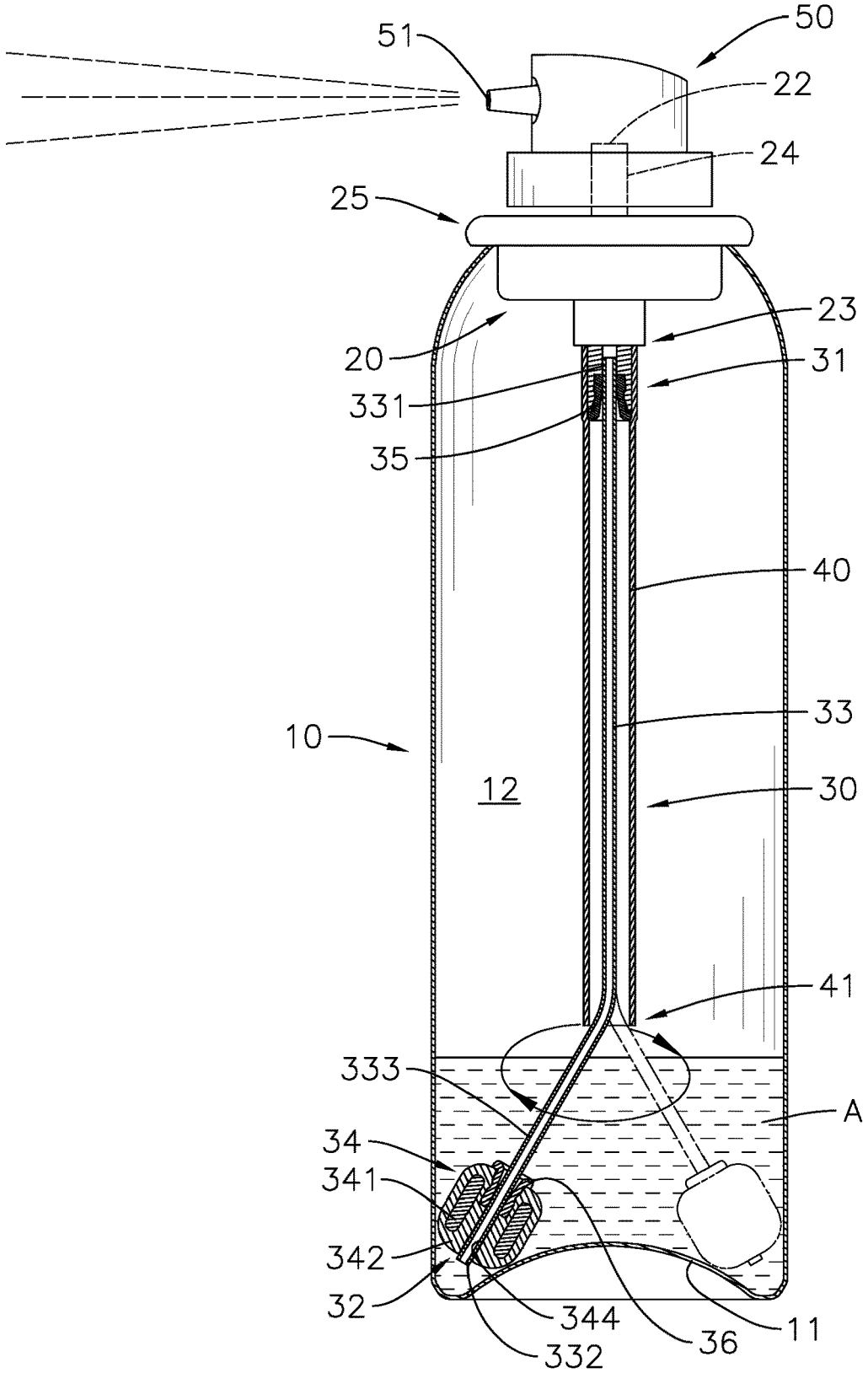
FIG. 1 is a sectional view of a first embodiment of an aerosol spray can in accordance with the present invention.

With reference to FIG. 1, an aerosol spray can of a first embodiment in accordance with the present invention comprises a can body 10, a valve assembly 20, a dip-tube assembly 30 and a rigid tube 40.

Figure 2:
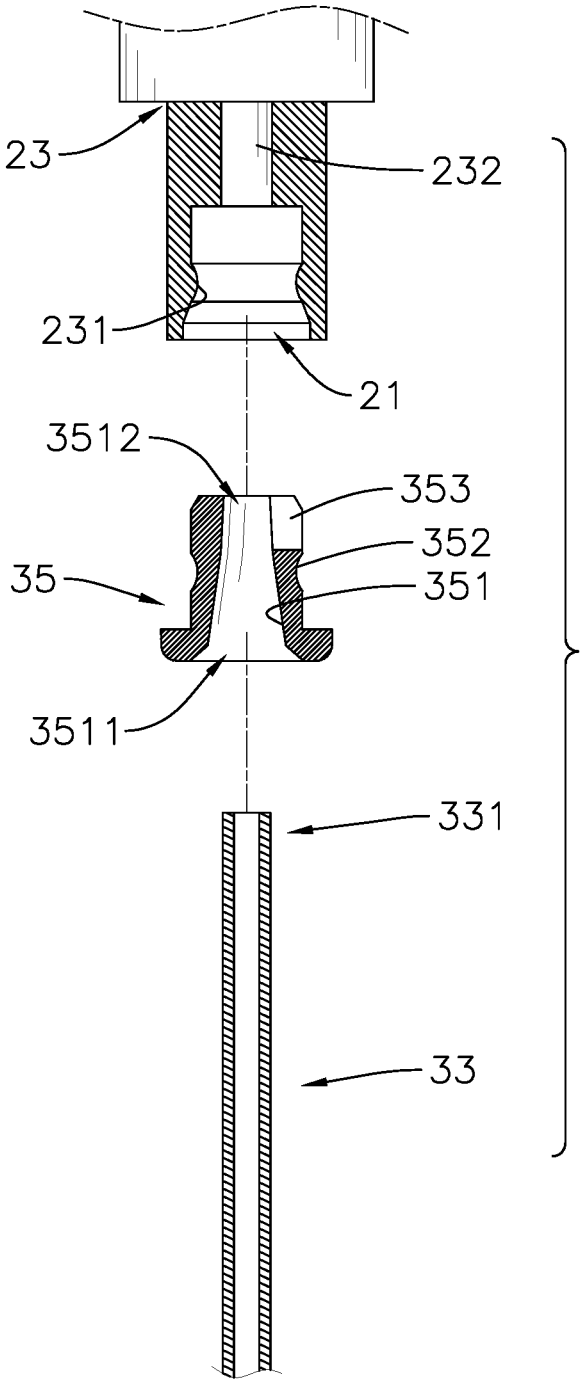
FIG. 2 is an exploded sectional view in partial section of the first embodiment of the aerosol spray can.

The can body 10 is hollow and has a crimping opening located on a top of the can body. In this preferred embodiment, the can body 10 is made of metal. A bottom wall 11 is mounted on a bottom of the can body 10. The bottom wall 11 is convex toward an inner space 12 of the can body 10 such that the can body 10 can maintain a standing position by having a circular rim of the bottom wall 11 abutting the ground The valve assembly 20 has a liquid product intake 21 and a liquid product outlet 22. The liquid product intake 21 is located in the inner space 12 of the can body 10. The liquid product outlet 22 is located outside of the can body 10. The liquid product intake 21 is selectively channel-linked to the liquid product outlet 22. The valve assembly 20 is open when the liquid product intake 21 is channel-linked to the liquid product outlet 22. With reference to FIG. 1 and FIG. 2, to be specific, the valve assembly 20 has a valve housing 23, a valve stem 24 and a metal mounting cup 25. The valve housing 23 is mounted on a bottom of the mounting cup 25. The mounting cup 25 is fixed to a mounting opening of the can body 10 and seals the mounting opening. The mounting opening is a crimping opening.

The liquid product intake 21 is formed on a bottom end of the valve housing 23. The valve stem 24 is a tubular body. A bottom end of the valve stem 24 is mounted in the valve housing 23, while a top end of the valve stem 24 is mounted through a central hole of the mounting cup 25 and protrudes from the mounting cup 25. The liquid product intake 21 is channel-linked to the liquid product outlet 22 via a liquid passage 232.

In the preferred embodiment, the aerosol spray can retains an actuator 50. The actuator 50 is usually mounted on the liquid product outlet 22, which is located on the top end of the valve stem 24. A spraying nozzle 51 of the actuator 50 is passage-linked to the liquid product outlet 22 of the valve stem 24. The valve assembly 20 is a prior art of standard valve assembly; therefore detailed description of the valve assembly 20 structure is omitted. In the preferred embodiment, the valve assembly 20 is a 1-inch valve.

Figure 9:
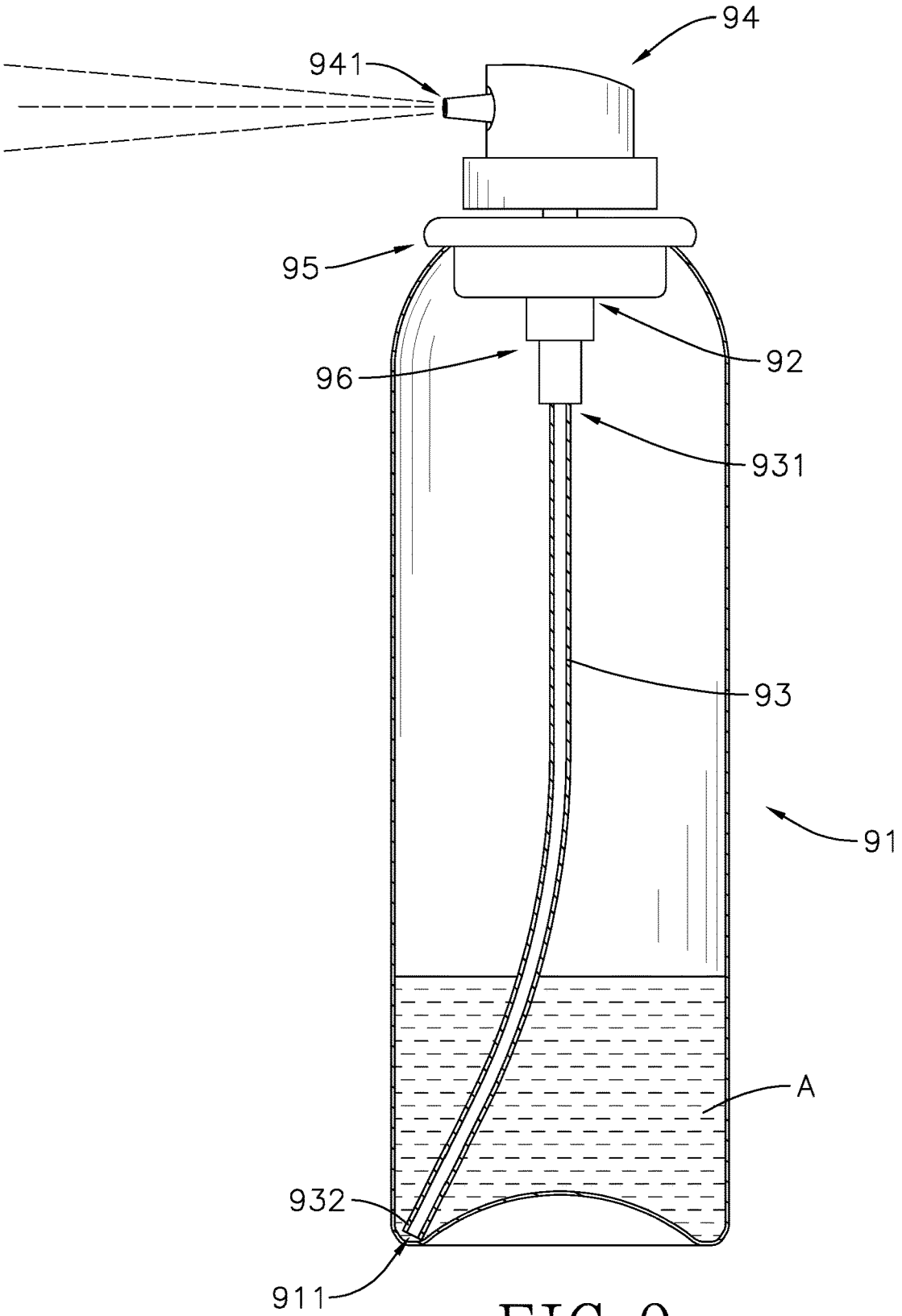
FIG.9 PRIOR ART
FIG. 9 is a sectional view of a conventional aerosol spray can.
Figure 10:
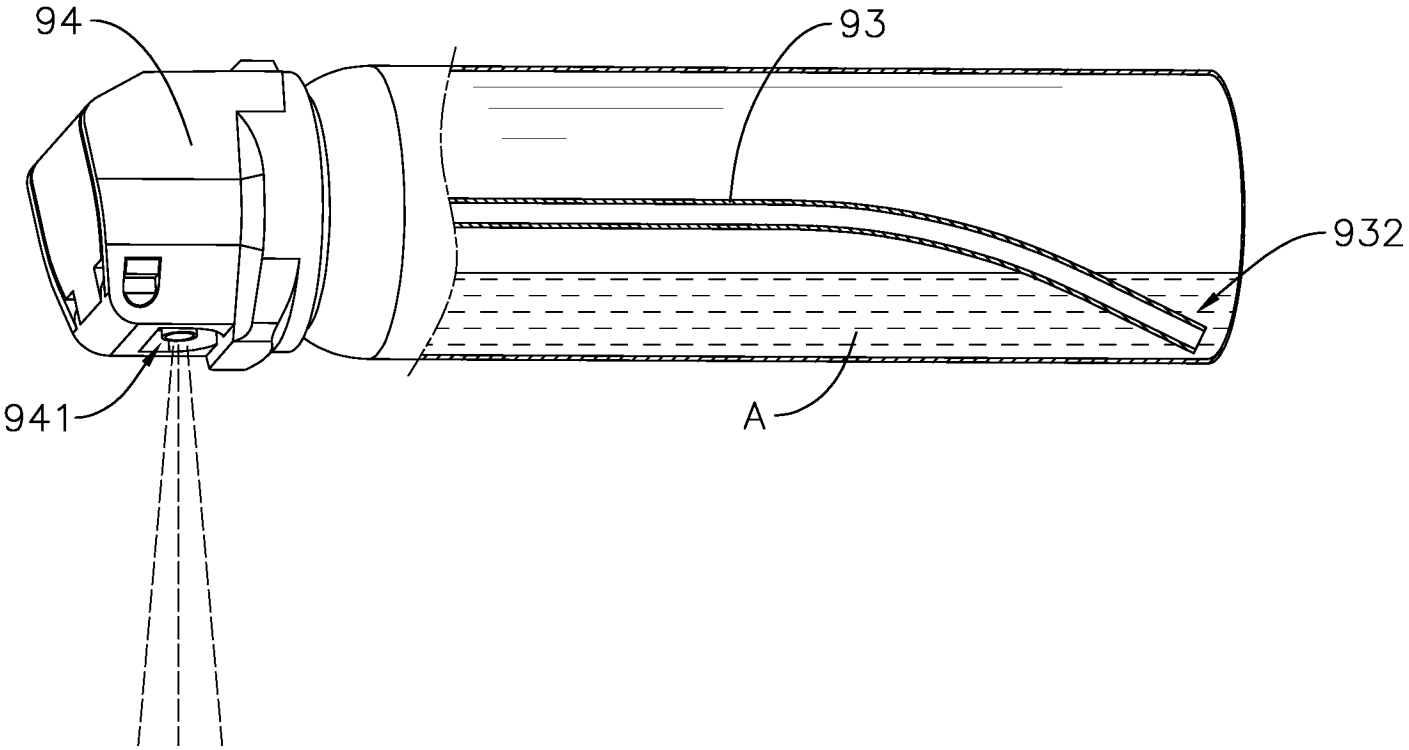
FIG. 10 PRIOR ART
FIG. 10 is a sectional view of another conventional aerosol spray can, showing the aerosol spray can being used in a horizontal position.
Figure 11:
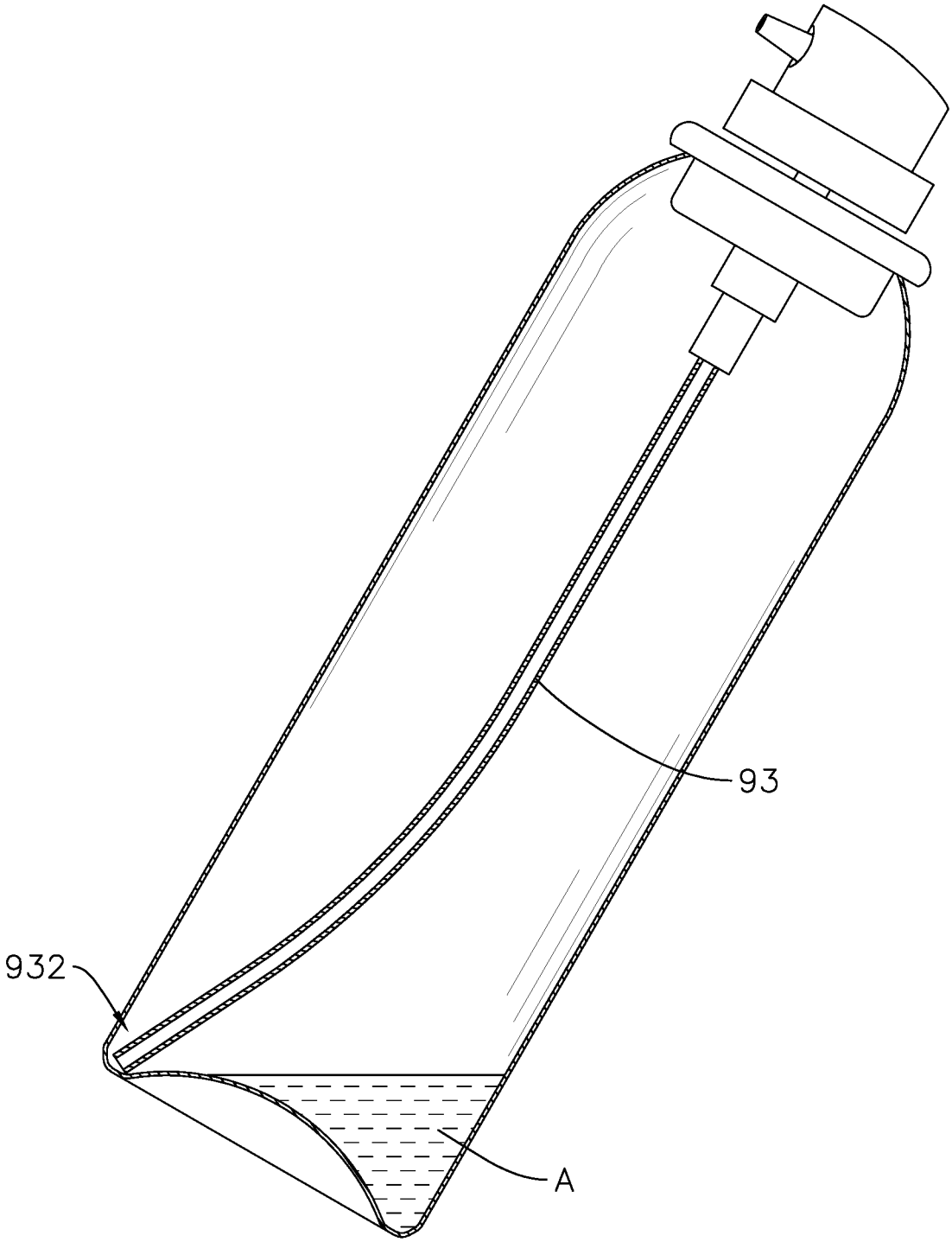
FIG. 11 PRIOR ART
FIG. 11 is a sectional view of the conventional aerosol spray can in FIG. 9, showing the aerosol spray can being used in a tilted position.
Figure 12:
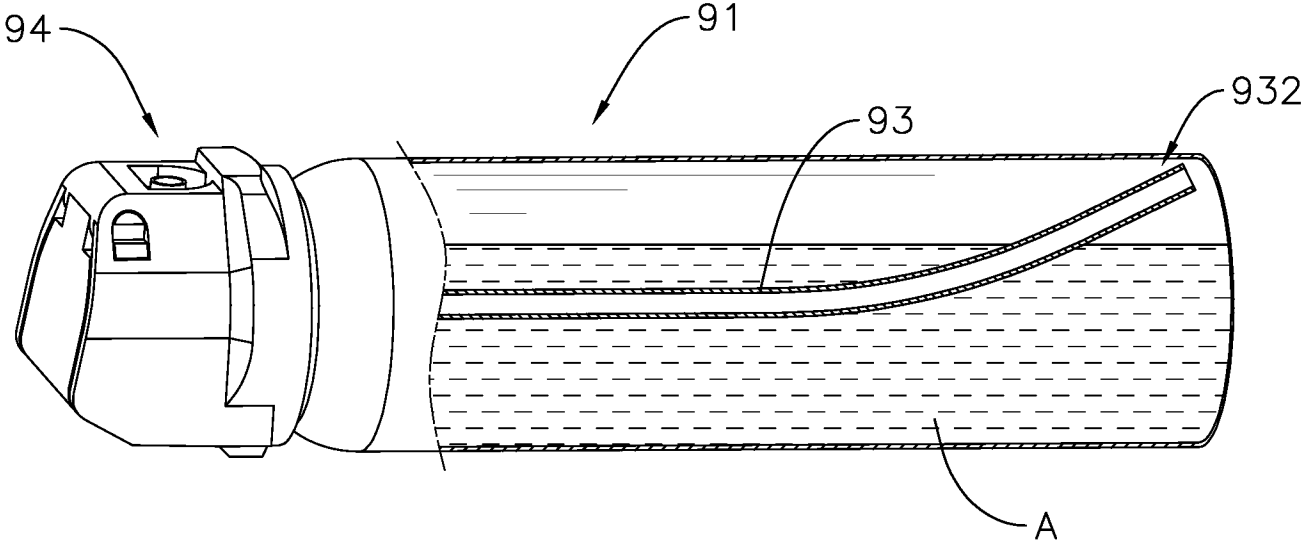
FIG. 12 PRIOR ART
FIG. 12 is a sectional view of the conventional small-volume aerosol spray can showing the aerosol spray can being used in a horizontal position.
Figure 13:
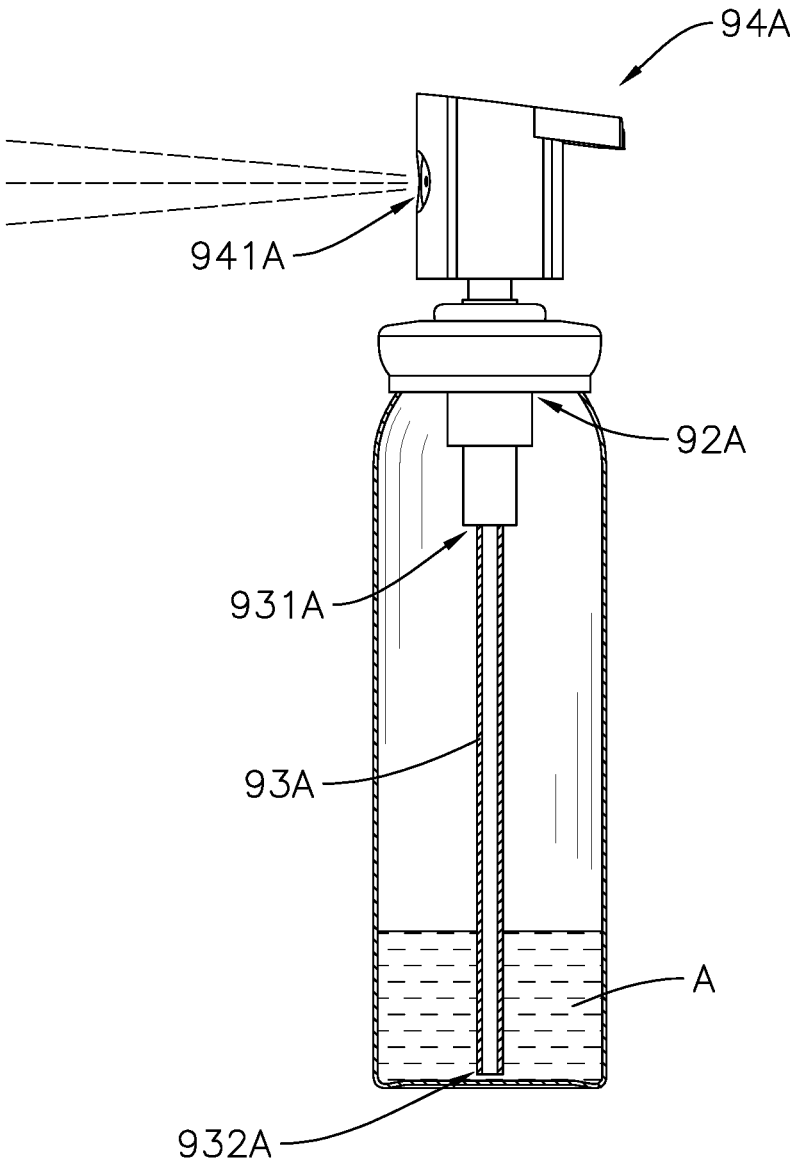
FIG.13 PRIOR ART
FIGS. 13 to 15 are sectional views of a small-volume conventional aerosol spray can, showing the aerosol spray can being used in different positions.
Figure 14:
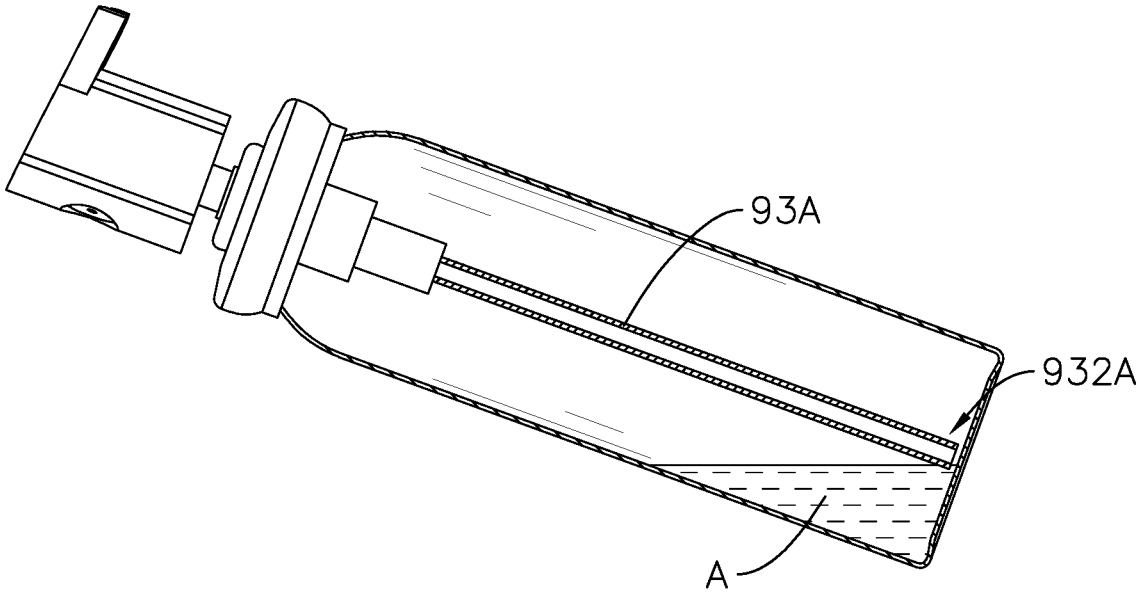
FIG. 14 PRIOR ART
Figure 15:
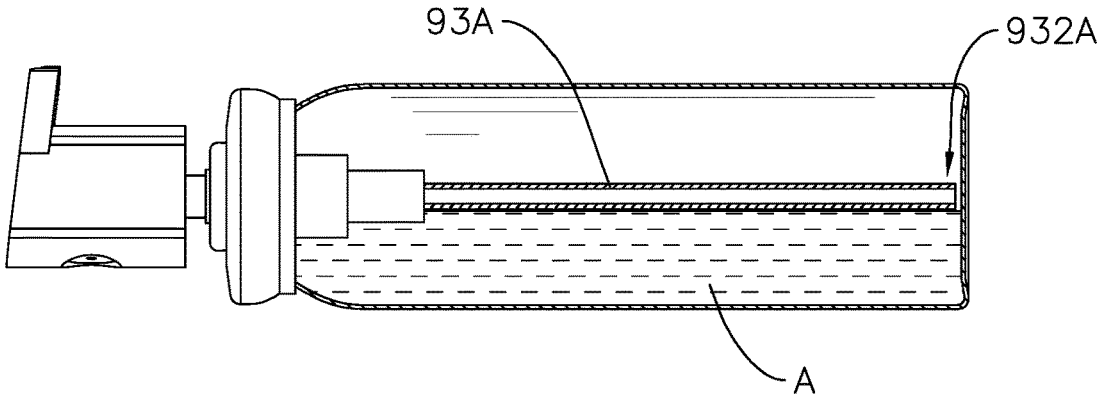
FIG. 15 PRIOR ART
Figure 16:
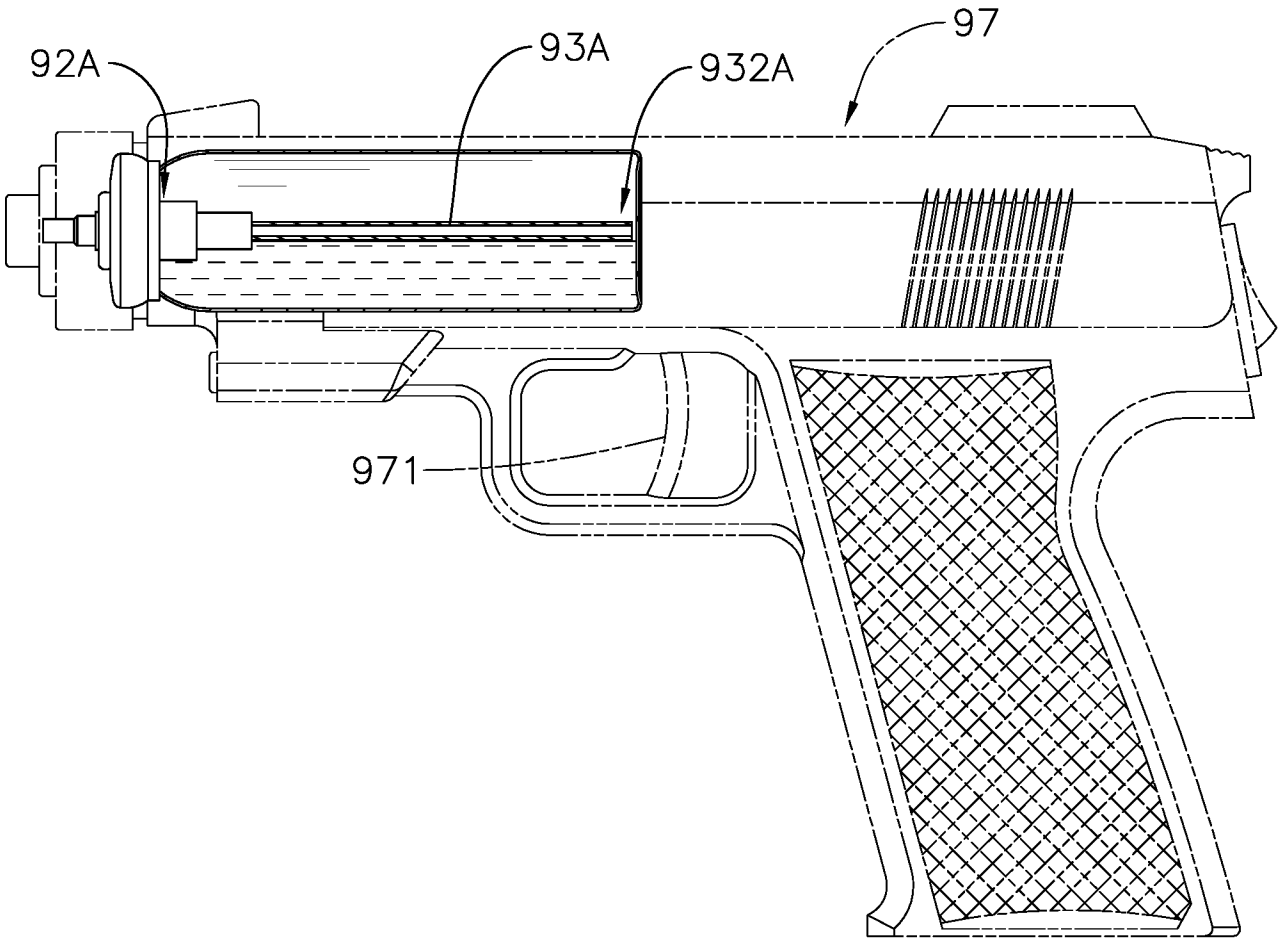
FIG. 16 PRIOR ART
FIG. 16 is a sectional view of another conventional aerosol spray can, showing the aerosol spray can being used in a horizontal position.

With reference to FIG. 9, a standard conventional valve assembly of a prior art has seven components as follows: a valve stem, a stem gasket, a mounting cup 95, a cup gasket, a valve housing 96, a spring, and a dip-tube 93, but said valve stem, said stem gasket, said cup gasket and said spring are not shown in figures.

The dip-tube assembly 30 has two channel-linked ends which are respectively a head end 31 and a tail end 32. The head end 31 is connected to the valve assembly 20 and is channel-linked to the liquid product intake 21 of the valve assembly 20. The tail end 32 extends toward the bottom of the can body 10 and is adjacent to the bottom of the can body 10. The dip-tube assembly 30 has a flexible tube 33 and a weight piece 34.

Two opposite ends of the flexible tube 33 are respectively a valve end 331 and a weight end 332. The valve end 331 is the head end 31 of the flexible tube 33. The valve end 331 is channel-linked to the liquid product intake 21 of the valve assembly 20. The weight end 332 extends toward the bottom of the can body 10. The flexible tube 33 is preferably made of a soft polyethylene (PE) tube with small diameter and therefore flexible. An inner diameter and an outer diameter of the flexible tube 33 are preferably 0.8 millimeters and 1.5 millimeters respectively. The recommended inner diameter of the flexible tube 33 is between 0.75 and 0.85 millimeters. The recommended outer diameter of the flexible tube 33 is between 1.40 and 1.55 millimeters. However, sizes and material of the flexible tube 33 are not limited thereto, as long as the flexible tube 33 can be bent and stretched by a weight of the weight piece 34.

Figure 3A:
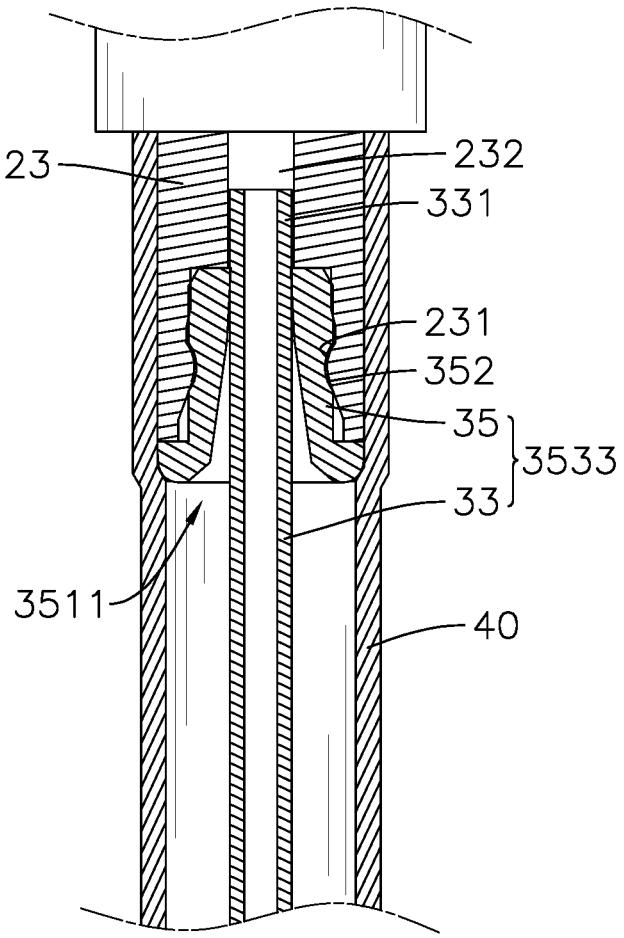
FIG. 3A is a sectional view in partial section of the first embodiment of the aerosol spray can.
Figure 3B:
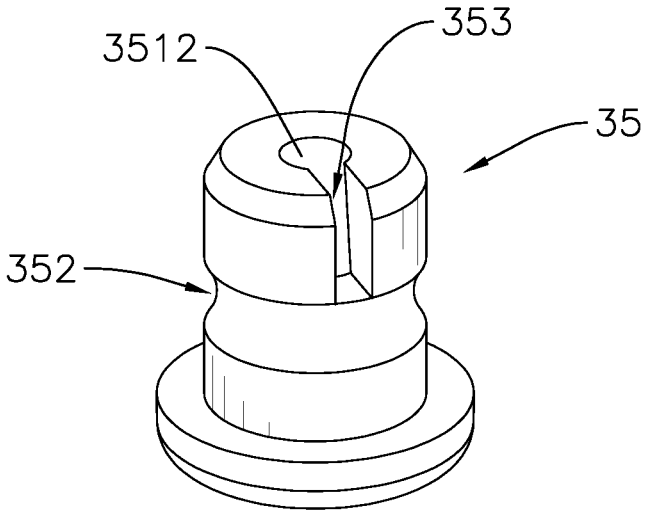
FIG. 3B is a perspective view of a valve-fixing bushing plug of the first embodiment of the aerosol spray can, showing an area near a valve end of the flexible tube.

With reference to FIG. 1 and FIG. 3B, the weight piece 34 is mounted to the weight end 332 of the flexible tube 33. The weight of the weight piece 34 makes the tail end 32 of the dip-tube assembly 30 move toward the ground automatically. To be precise, when a side of the can body 10 tilts toward the ground, the flexible tube 33 is subjected to the weight of the weight piece 34 such that the flexible tube 33 can be bent and stretched properly to make the tail end 32 of the dip-tube assembly 30 move toward the ground.

In the preferred embodiment, a mounting hole 344 is formed in a center of the weight piece 34. The weight end 332 of the flexible tube 33 is mounted through the mounting hole 344, protrudes from an opening of the mounting hole facing toward the bottom of the can body, and is adjacent to the bottom of the can body 10 such that the weight end 332 of the flexible tube 33 forms the tail end 32 of the dip-tube assembly 30. In another preferred embodiment, instead of protruding from the mounting hole 344, the weight end 332 of the flexible tube 33 can be mounted inside the mounting hole 344 such that the weight piece 34 forms the tail end 32 of the dip-tube assembly 30.

The weight piece 34 has a weight ring 341 and a buffer shell 342. The weight ring 341 is preferably, but not limited to, a metal ring. The weight ring 341 can also be a cylindrical ferrule or a plate. Furthermore, the weight ring 341 can be made of other high-density materials such as glass or ceramic to increase the heaviness of the weight ring 341 and therefore enhance the responsiveness of driving the tail end 32 of the dip-tube assembly 30 toward the ground. The buffer shell 342 is made of plastic, and preferably made of polyethylene or polypropylene. The buffer shell 342 is wrapped around the weight ring 341 to prevent the noise and structural damage of weight piece 34 incurred by direct impact of weight ring 341 to the can body 10. A size and shape of the weight piece 34 can be modified according to the inner space 12 near the bottom of the can body 10.

With reference to FIGS. 2, 3A, and 3B, in the preferred embodiment, the dip-tube assembly 30 has a valve-fixing bushing plug 35 and a weight-fixing bushing plug 36. The valve end 331 of the flexible tube 33 is mounted through the valve-fixing bushing plug 35. The valve-fixing bushing plug 35 is annular to form a valve-fixing hole 351. A first bushing plug opening 3511 and a second bushing plug opening 3512 are formed respectively on an upper end and a lower end of the valve-fixing hole 351. A diameter of the second bushing plug opening 3512 is slightly smaller than a diameter of the first bushing plug opening 3511 so that a shape of the valve-fixing hole 351 is conical.

A free inner diameter of the second bushing plug opening 3512 of the valve-fixing bushing plug 35, and the inner diameter of the second bushing opening 3512, before it is slipped onto the flexible tube 33, is smaller than the outer diameter of the flexible tube 33. A slot 353 is formed through an annular wall of the valve-fixing bushing plug 35 with a valve-fixing engaging portion 352. The slot 353 extends to the second bushing plug opening 3512 of the valve-fixing bushing plug 35; therefore the second bushing plug opening 3512 is able to expand its elasticity easier. Therefore, the slot 353 makes it easier for the valve end 331 of the flexible tube 33 to insert into the first bushing opening 3511 and mount through the valve-fixing hole 351. A proper length of the valve end 331 protrudes from the second bushing plug opening 3512. The second bushing plug opening 3512 surrounds and holds the flexible tube 33 tightly to restrict the flexible tube 33 from sliding such that the flexible tube 33 is clamped and fixed in the valve-fixing hole 351. The valve-fixing engaging portion 352 is formed on the outer annular wall of the valve-fixing bushing plug 35. The valve-fixing engaging portion 352 is preferably an annular groove.

The valve housing 23 of the valve assembly 20 has a valve engaging portion 231 corresponding to the valve-fixing bushing plug 35 and a liquid passage 232. The valve engaging portion 231 is a rib formed on the inner annular wall of socket-shape space of the valve housing 23 which is corresponding to the shape contour of plug 35. Said inner annular wall of the valve housing 23 corresponds in position to the outer annular surface of the valve-fixing bushing plug 35. The liquid passage 232 is formed in an inner space of the valve housing 23 and is channel-linked to the liquid product outlet 22 of the valve stem 24. The flexible tube 33 is fixed in the valve-fixing bushing plug 35, meaning that an assembled piece 3533 is formed by putting the valve-fixing bushing plug 35 and the flexible tube 33 together. When connecting the flexible tube 33 to the valve housing 23, firstly put the valve-fixing bushing plug 35 and the flexible tube 33 together to form the assembled piece 3533, and then insert the valve-fixing bushing plug 35, which is located at an end of the assembled piece 3533 where the valve end 331 of the flexible tube 33 protrudes, toward the inner space of the valve housing 23, forcing the valve-fixing engaging portion 352 of the valve-fixing bushing plug 35 to engage with the valve engaging portion 231 of the valve housing 23. The valve end 331 of the flexible tube 33 is inserted into the liquid passage 232 automatically.

Figure 3C:
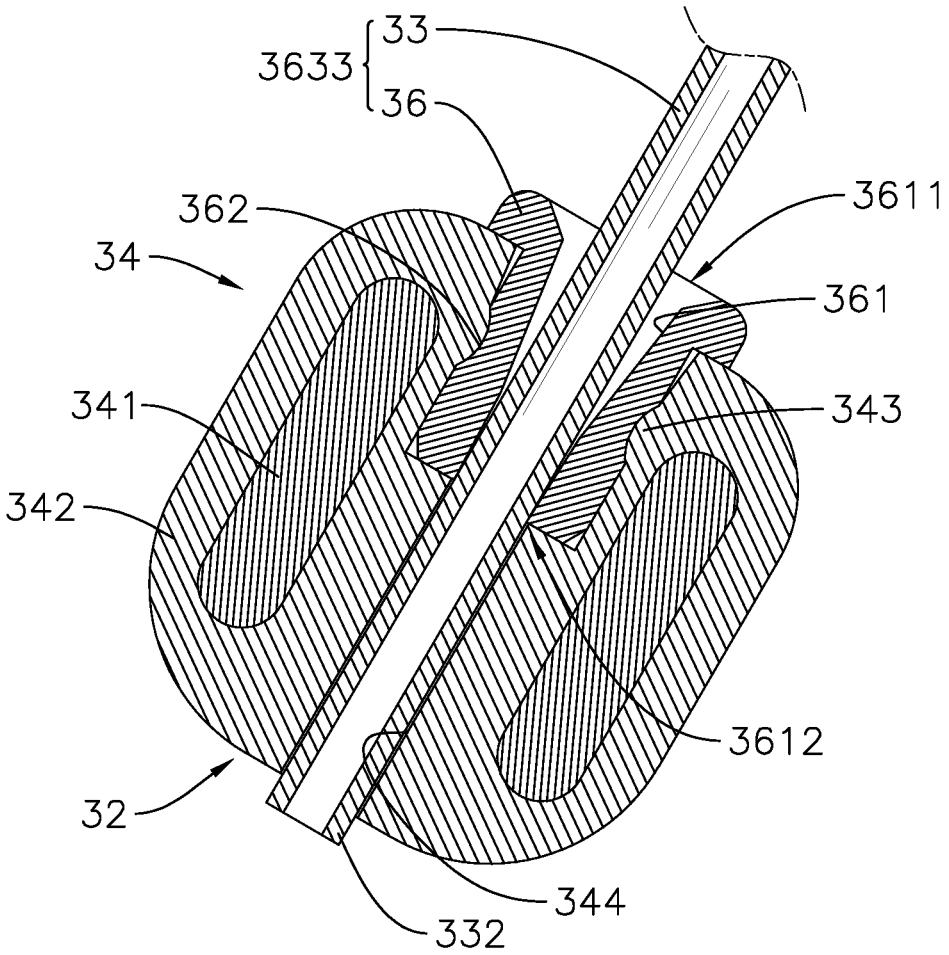
FIG. 3C is a sectional view in partial section of the first embodiment of the aerosol spray can, showing an area near a weight end of the flexible tube.

With reference to FIG. 3C, to be precise, shape, specifications, and structure of the weight-fixing bushing plug 36 are identical to those of the valve-fixing bushing plug 35. The weight end 332 of the flexible tube 33 is mounted through the weight-fixing bushing plug 36. The weight-fixing bushing plug 36 is annular to form a weight-fixing hole 361. A first bushing opening 3611 and a second bushing plug opening 3612 are formed respectively on an upper end and a lower end of the weight-fixing hole 361.

A diameter of the second bushing opening plug 3612 is slightly smaller than a diameter of the first bushing plug opening 3611 so that a shape of the weight-fixing hole 361 is conical.

A free inner diameter of the second bushing plug opening 3612 of the weight-fixing hole 361, and the inner diameter of the second bushing opening 3612, before it is slipped onto the flexible tube 33, is smaller than the outer diameter of the flexible tube 33. A slot (reference character not assigned) is formed through an annular wall of the weight-fixing bushing plug 36 with a weight-fixing engaging portion 362. The slot extends to the second bushing plug opening 3612 of the weight-fixing bushing plug 36; therefore the second bushing opening 3612 is able to expand its elasticity easier. Therefore, the slot of the weight-fixing bushing plug 36 makes it easier to insert the weight end 332 of the flexible tube 33 into the first bushing opening 3611 and mount through the weight-fixing hole 361. A proper length of the weight end 332 protrudes from the second bushing opening 3612. The second bushing opening 3612 surrounds and clamps the flexible tube 33 tightly to restrict the flexible tube 33 from sliding such that the flexible tube 33 is clamped and fixed in the weight-fixing hole 361. A weight-fixing engaging portion 362 is formed on an outer annular surface of the weight-fixing bushing plug 36.

The weight piece 34 has a weight-piece engaging portion 343 and a mounting hole 344. The weight-piece engaging portion 343 is formed on an inner annular wall of the space contour of the weight piece 34, and is an annular rib. Said inner space contour of the weight piece 34 is corresponding to the outer shape contour of the weight-fixing bushing plug 36. The mounting hole 344 is formed through the center of the weight piece 34. Similar to the aforementioned valve-fixing bushing plug 35, the flexible tube 33 is fixed in the weight-fixing bushing plug 36, meaning that an assembled piece 3633 is formed by putting the weight-fixing bushing plug 36 and the flexible tube 33 together. When connecting the flexible tube 33 to the weight piece 34, firstly put the weight-fixing bushing plug 36 and the flexible tube 33 together to form the assembled piece 3633, and then insert the weight-fixing bushing 36, which is located at an end of the assembled piece 3633 where the weight end 332 of the flexible tube 33 protrudes, toward the inner space of the weight piece 34, forcing the weight-fixing engaging portion 362 of the weight-fixing bushing 36 to engage with the weight-piece engaging rib 343 of the weight piece 34. The weight end 332 of the flexible tube 33 is inserted into the mounting hole 344 and protrudes from a bottom of the weight piece 34.

The two opposite ends of the rigid tube 40 are respectively a top end and a bottom end 41. The top end of the rigid tube 40 is connected to the bottom end of the valve housing 23. The bottom end 41 of the rigid tube 40 extends toward the bottom of the can body 10. The rigid tube 40 is sleeved around the flexible tube 33 of the dip-tube assembly 30. The bottom end 41 of the rigid tube 40 is located above the weight piece 34, which dangles under the flexible tube 33. The weight end 332 of the flexible tube 33 protrudes downward from the bottom end 41 of the rigid tube 40. The flexible tube 33 further has an exposed section 333 (as shown in FIG. 1) protruding from the bottom end of the rigid tube 40. The exposed section 333 is located between the bottom end of the rigid tube 40 and a top of the weight piece 34. The exposed section 333 is adequately flexible and moderately stretchable. Because the exposed section 333 is not restrained by the rigid tube 40, the exposed section 333 can move or swing freely. The exposed section 333 keeps almost original flexibility and physical properties to bend and stretch. The exposed section 333 is capable of abutting against an opening of the bottom end of the rigid tube 40 to support the weight of the weight piece 34 and enable the weight piece to move responsively toward the liquid product A and remain submerged in the liquid product A regardless that the can body is in an upright position, any tilted position even with rotating condition, a horizontal position even when only less than a half of the liquid product A is left in the can body 10. The rigid tube 40 is preferably a straight and rigid polyethylene tube. An inner diameter of the rigid tube 40 is slightly larger than the outer diameter of the flexible tube 33.

In other words, if the rigid tube 40 is omitted, a position of the weight piece 34 can easily be affected by propellant inside the can body 10, causing the weight piece 34 to be tangled or inverted regardless that the weight piece 34 is located under or above a level of the liquid product A. As a result, the liquid product A inside the can body 10 cannot be sprayed because the tail end 32 of the dip-tube assembly 30 cannot be submerged under the liquid product A.

For example, when a user intends to uses a bug spray to target a mosquito that flies and buzzes around or to uses a pepper spray against an assailant or harasser, the user may operate the aerosol spray can dynamically and cause the weight piece 34 to be tangled or inverted, which will result that the liquid product A inside the can body 10 cannot be sprayed because the tail end 32 of the dip-tube assembly 30 cannot be submerged under the liquid product A.

Therefore, the flexible tube 33 must have the exposed section 333 that protrudes from the bottom end 41 of the rigid tube 40 to be flexible and stretchable without the restraint of the rigid tube 40 when the exposed section 333 is driven by the weight of the weight piece 34 so that the tail end 32 of the dip-tube assembly 30 can move responsively and stay submerged in the liquid product A.

When using the present invention, fill the can body 10 with liquid product A and the propellant (propellant not shown in figures). When the actuator 50 is pressed down by the user, the valve stem 24 is in an open status, which allows the liquid product A to be sprayed from the spraying nozzle 51 of the actuator 50 via the weight end 332 of the flexible tube 33, the valve housing 23, and the liquid product outlet 22 of the valve stem 24 due to pressure inside the can body 10 formed by the propellant. The propellant is preferably DME (methoxymethane) or compressed nitrogen. The liquid product A is a pre-mixed compound such as pesticide or peppery essence (oleoresin capsicum).

Figure 4:
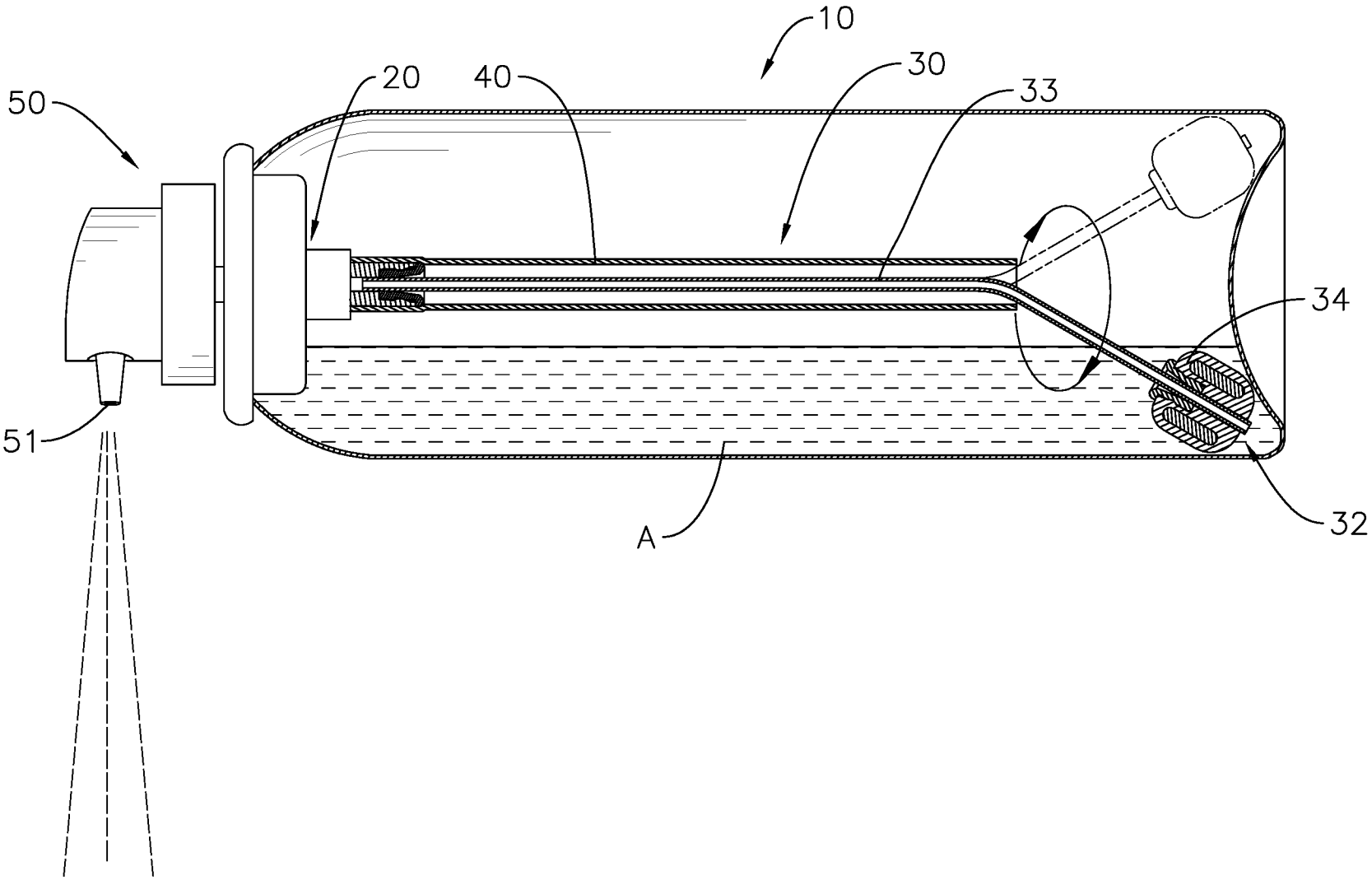
FIG. 4 is a sectional view of the first embodiment of the aerosol spray can, showing the aerosol spray can being used in a horizontal position.
Figure 5:
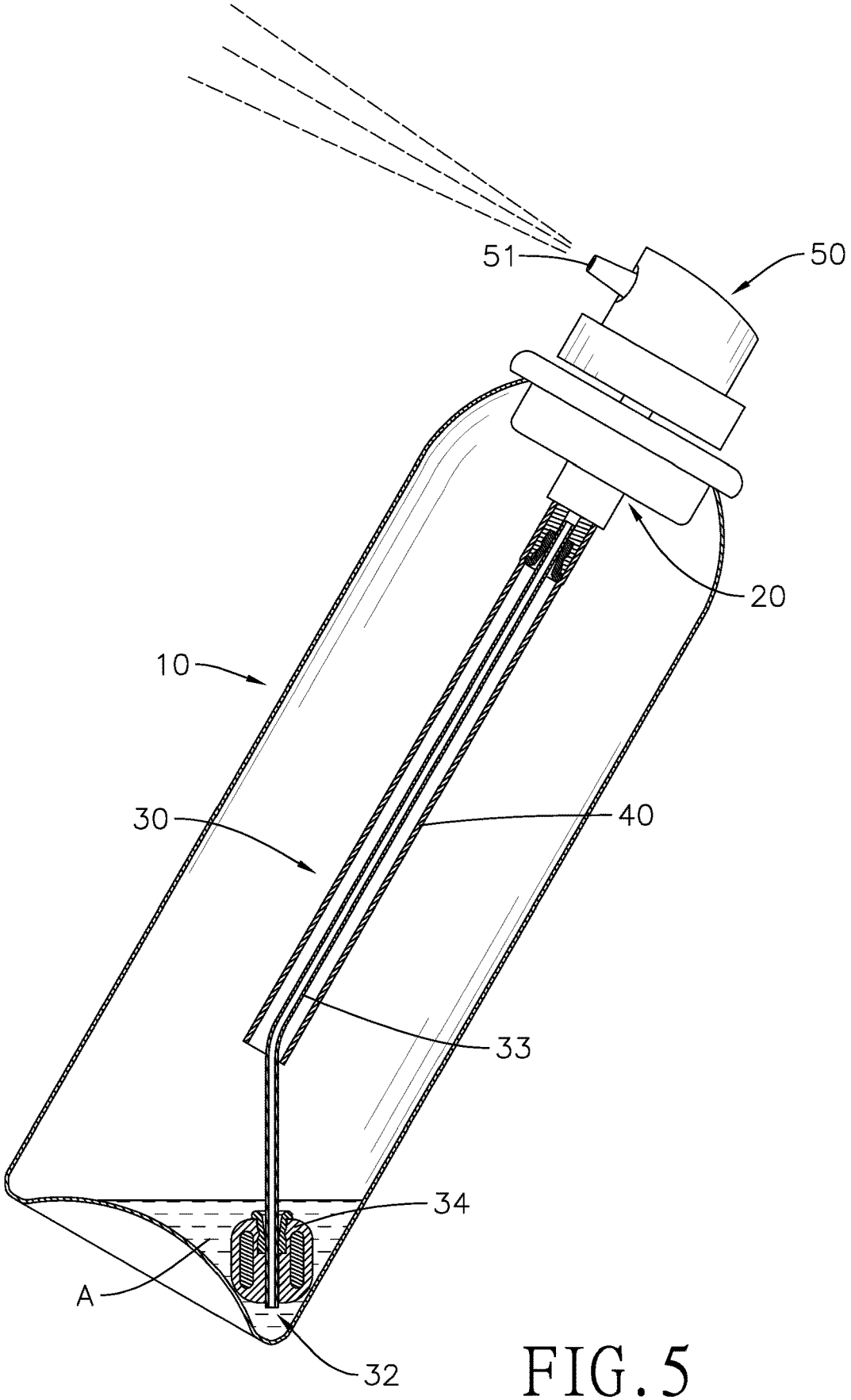
FIG. 5 is a sectional view of the first embodiment of the aerosol spray can, showing the aerosol spray can being used in a tilted position.

With reference to FIG. 4 and FIG. 5, when the can body 10 of a first embodiment in accordance with the present invention can body 10 is tilted or in a horizontal position such that the liquid product A flows from the bottom of the can body 10 toward a side wall of the can body 10 due to gravity, the weight piece 34 also responsively moves the tail end 32 of the dip-tube assembly 30 toward a position on the side wall of the can body 10 where the liquid product A stays due to gravity. As a result, a liquid opening on the tail end 32 of the dip-tube assembly 30 stays submerged in the liquid product A and the aerosol spray can is able to spray the liquid product A even when the aerosol spray can is tilted or in nearly horizontal position. In the first embodiment, the valve assembly 20 is a 1-inch valve. Most commonly seen standard valve assemblies 20 include 1-inch valves and 20-millimeter valves, wherein the 1-inch valves are used with large-volume cans, while the 20-millimeter valves are used with small-volume cans.

Figure 6:
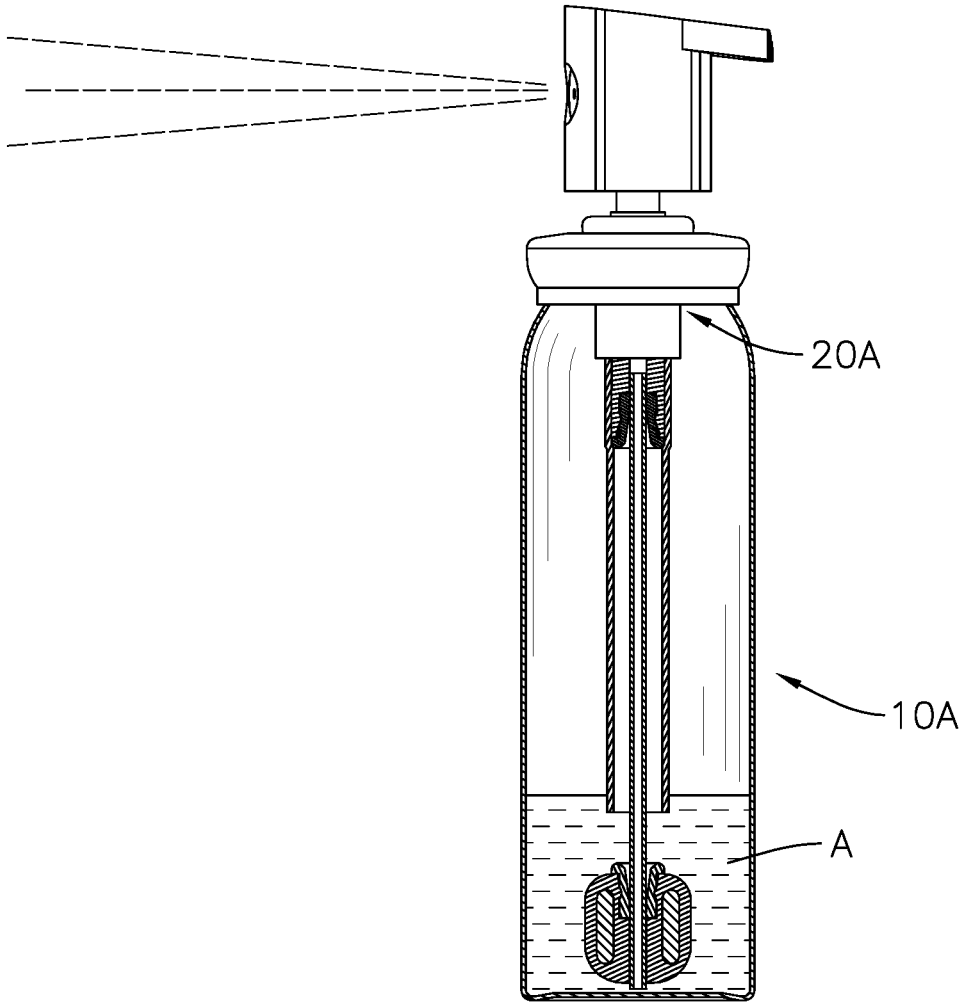
FIG. 6 is a sectional view of a second embodiment of an aerosol spray can in accordance with the present invention.
Figure 7:
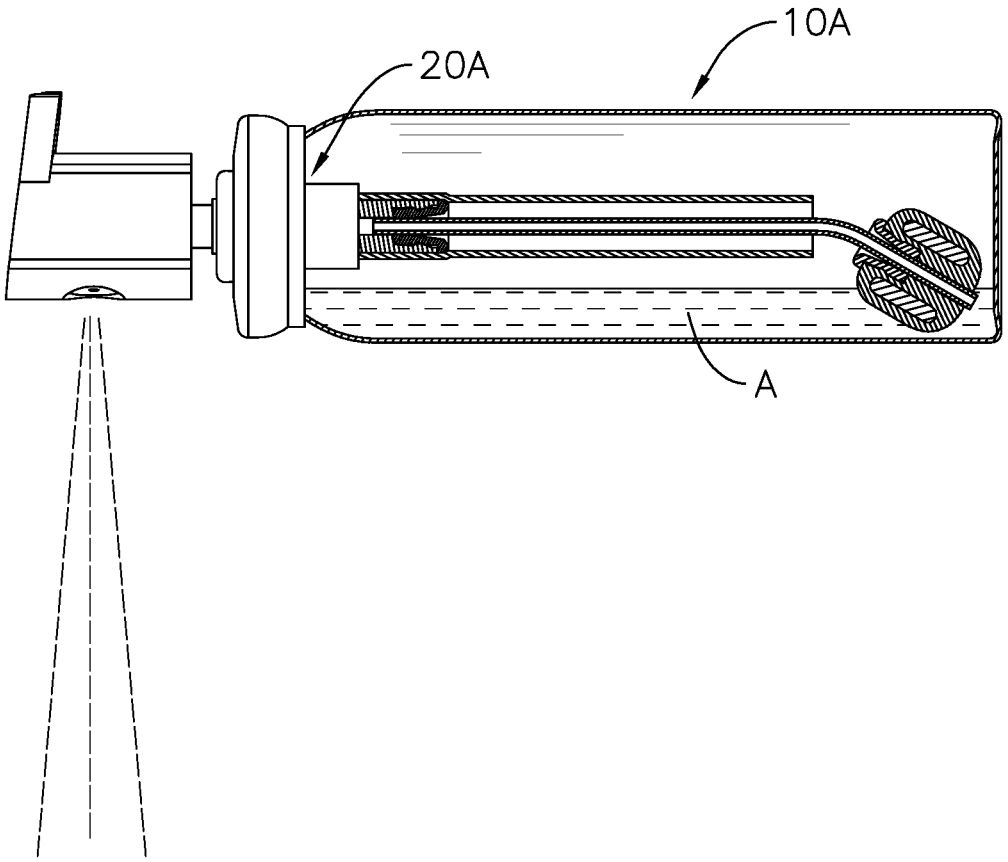
FIG. 7 is a sectional view of the second embodiment of the aerosol spray can, showing the aerosol spray can being used in a horizontal position.
Figure 8:
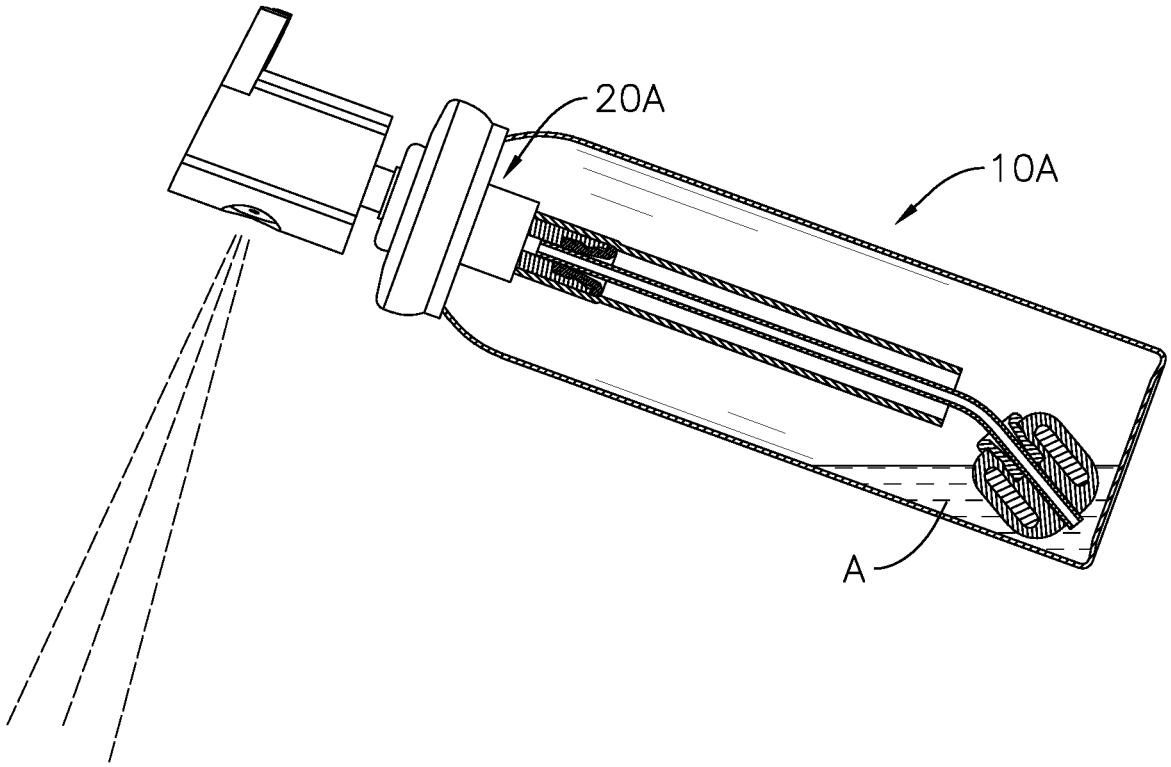
FIG. 8 is a sectional view of the second embodiment of the aerosol spray can, showing the aerosol spray can being used in a tilted position.

With reference to FIGS. 6 to 8, a second embodiment in accordance with the present invention is substantially the same as the first embodiment, except that the can body 10A is a small-volume can, and the valve assembly 20A of the aerosol spray can has a 20-millimeter valve.

In summary, the dip-tube assembly 30 has the flexible tube 33 and the weight piece 34. The weight piece 34 is mounted to the tail end 32 of the flexible tube 33. The weight end 332 of the flexible tube 33 is inserted downward into the rigid tube 40 and protrudes from the bottom end 41 of the rigid tube 40. The exposed section 333 protrudes from the bottom end of the rigid tube 40. The exposed section 333 is located between the bottom end of the rigid tube 40 and a top of the weight piece 34, and is adequately flexible and moderately stretchable. Therefore, the weight of the weight piece 34 is able to drive the tail end 32 of the dip-tube assembly 30 freely toward the ground. The liquid opening on the weight end 332 can be moved by the weight of the weight piece 34, which dangles under the flexible tube 33, and responsively moves toward a corner of the can body 10 where the side wall of the can body 10 and the bottom of the can body 10 are connected regardless that the can body 10 is in an upright position, any tilted position even with rotating condition or a horizontal position even when only less than a half of the liquid product A is left in the can body 10. Because the liquid product also stays in said corner of the can body 10, the present invention can spray nearly all liquid product A inside the can body 10, thereby reducing the waste of content due to excessive liquid product A that cannot be used and thus is left in the can body 10.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An aerosol spray can comprising:

a can body being hollow and having a mounting opening;

a valve assembly fixed to the mounting opening and sealing the mounting opening; the valve assembly having a liquid product intake located in an inner space of the can body; and a liquid product outlet located outside of the can body; the liquid product intake being selectively channel-linked with the liquid product outlet;

a dip-tube assembly connected to the valve assembly and having:

a tail end channel-linked with the liquid product intake of the valve assembly and extending toward a bottom of the can body; the tail end being adjacent to the bottom of the can body;

a flexible tube; two opposite ends of the flexible tube being a valve end and a weight end respectively;

the valve end channel-linked with the liquid product intake of the valve assembly;

the weight end extending toward the bottom of the can body; and a weight piece mounted to the weight end of the flexible tube; the weight piece having a weight ring; and a buffer shell wrapped around the weight ring;

wherein when the can body is tilted, the tail end of the dip-tube assembly is driven by a weight of the weight piece and moved toward the ground;

a rigid tube sleeved around the flexible tube and having a top end connected to the valve assembly;

a bottom end extending toward the bottom of the can body;

wherein the weight end of the flexible tube protrudes from the bottom end of the rigid tube;

the flexible tube has an exposed section protruding from the bottom end of the rigid tube; the exposed section is located between the bottom end of the rigid tube and a top of the weight piece.

2. The aerosol spray can as claimed in claim 1, wherein the dip-tube assembly further has a weight-fixing bushing plug; the weight-fixing bushing plug is annular to form a weight-fixing hole; the weight-fixing hole is slipped onto the weight end of the flexible tube such that the flexible tube is fixed through the weight-fixing hole.

3. The aerosol spray can as claimed in claim 2, wherein two opposite openings of the weight-fixing hole are respectively a first bushing opening and a second bushing opening;

the weight-fixing bushing plug has a slot formed through an annular wall of the weight-fixing bushing plug; the slot extends to the second bushing opening of the weight-fixing bushing plug to enhance elastic expansion of the second bushing opening.

4. The aerosol spray can as claimed in claim 3, wherein a diameter of the weight-fixing hole decreases gradually; when the weight-fixing hole is not slipped on and around the flexible tube, a diameter of the second bushing opening of the weight-fixing hole is smaller than an outer diameter of the flexible tube.

5. The aerosol spray can as claimed in claim 2, wherein the weight-fixing bushing plug has a weight-fixing engaging portion formed on an outer annular surface of the weight-fixing bushing plug; the weight-fixing engaging portion is an annular groove;

the weight piece has a weight-piece engaging portion formed on an inner annular wall of the weight piece; the weight-piece engaging portion is an annular rib on the inner annular wall of the weight piece; an inner space contour of the weight piece is corresponding to an outer shape contour of the weight-fixing bushing plug;

the weight-piece engaging portion of the weight piece engages with the weight-fixing engaging portion of the weight-fixing bushing plug.

6. The aerosol spray can as claimed in claim 4, wherein the weight-fixing bushing plug has a weight-fixing engaging portion formed on an outer annular surface of the weight-fixing bushing plug; the weight-fixing engaging portion is an annular groove;

the weight piece has a weight-piece engaging portion formed on an inner annular surface of the weight piece; the weight-piece engaging portion is an annular rib;

the weight-piece engaging portion of the weight piece engages with the weight-fixing engaging portion of the weight-fixing bushing plug.

7. The aerosol spray can as claimed in claim 1, wherein the dip-tube assembly further has a valve-fixing bushing plug; the valve-fixing bushing plug has a valve-fixing hole; the valve-fixing hole is slipped on and around the valve end of the flexible tube such that the flexible tube is tightly fixed through the valve-fixing hole.

8. The aerosol spray can as claimed in claim 6, wherein the dip-tube assembly further has a valve-fixing bushing plug; the valve-fixing bushing plug has a valve-fixing hole; the valve-fixing hole is slipped on and around the valve end of the flexible tube such that the flexible tube is tightly fixed through the valve-fixing hole.

9. The aerosol spray can as claimed in claim 1, wherein the valve assembly further has a valve housing; the liquid product intake located on a bottom of the valve housing; and a valve stem; a bottom end of the valve stem mounted in the valve housing; the liquid product outlet located on a top of the valve stem.

10. The aerosol spray can as claimed in claim 8, wherein the valve assembly further has a valve housing; the liquid product intake located on a bottom of the valve housing; and a valve stem; a bottom end of the valve stem mounted in the valve housing; the liquid product outlet located on a top of the valve stem.

11. The aerosol spray can as claimed in claim 1, wherein a mounting hole is formed in the weight piece;

the flexible tube is mounted through the mounting hole of the weight piece; the weight end of the flexible tube is adjacent to the bottom of the can body.

12. The aerosol spray can as claimed in claim 10, wherein a mounting hole is formed in the weight piece;

the flexible tube is mounted through the mounting hole of the weight piece; the weight end of the flexible tube is adjacent to the bottom of the can body.

13. The aerosol spray can as claimed in claim 1, wherein the flexible tube is made of polyethylene; an inner diameter of the flexible tube is between 0.75 and 0.85 millimeters; an outer diameter of the flexible tube is between 1.4 and 1.55 millimeters.

14. The aerosol spray can as claimed in claim 12, wherein the flexible tube is made of polyethylene; an inner diameter of the flexible tube is between 0.75 and 0.85 millimeters; the outer diameter of the flexible tube is between 1.4 and 1.55 millimeters.

15. An aerosol spray can comprising:

a can body being hollow and having a mounting opening;

a valve assembly fixed to the mounting opening and sealing the mounting opening; the valve assembly having a liquid product intake located in an inner space of the can body; and a liquid product outlet located outside of the can body; the liquid product intake being selectively channel-linked with the liquid product outlet;

a dip-tube assembly connected to the valve assembly and having:

a tail end channel-linked with the liquid product intake of the valve assembly and extending toward a bottom of the can body; the tail end being adjacent to the bottom of the can body;

a flexible tube; two opposite ends of the flexible tube being a valve end and a weight end respectively;

the valve end channel-linked with the liquid product intake of the valve assembly;

the weight end extending toward the bottom of the can body; and a weight piece mounted to the weight end of the flexible tube; wherein when the can body is tilted, the tail end of the dip-tube assembly is driven by a weight of the weight piece and moved toward the ground; and a weight-fixing bushing plug being annular to form a weight-fixing hole; the weight-fixing hole slipped onto the weight end of the flexible tube such that the flexible tube is fixed through the weight-fixing hole; two opposite openings of the weight-fixing hole being respectively a first bushing opening and a second bushing opening; the weight-fixing bushing plug having a slot formed through an annular wall of the weight-fixing bushing plug; the slot extending to the second bushing opening of the weight-fixing bushing plug to enhance elastic expansion of the second bushing opening; and a rigid tube sleeved around the flexible tube and having a top end connected to the valve assembly;

a bottom end extending toward the bottom of the can body;

wherein the weight end of the flexible tube protrudes from the bottom end of the rigid tube;

the flexible tube has an exposed section protruding from the bottom end of the rigid tube; the exposed section is located between the bottom end of the rigid tube and a top of the weight piece.

16. An aerosol spray can comprising:

a can body being hollow and having a mounting opening;

a valve assembly fixed to the mounting opening and sealing the mounting opening; the valve assembly having a liquid product intake located in an inner space of the can body; and a liquid product outlet located outside of the can body; the liquid product intake being selectively channel-linked with the liquid product outlet;

a dip-tube assembly connected to the valve assembly and having:

a tail end channel-linked with the liquid product intake of the valve assembly and extending toward a bottom of the can body; the tail end being adjacent to the bottom of the can body;

a flexible tube; two opposite ends of the flexible tube being a valve end and a weight end respectively;

the valve end channel-linked with the liquid product intake of the valve assembly;

the weight end extending toward the bottom of the can body; and a weight piece mounted to the weight end of the flexible tube; wherein when the can body is tilted, the tail end of the dip-tube assembly is driven by a weight of the weight piece and moved toward the ground; and a valve-fixing bushing plug having a valve-fixing hole; the valve-fixing hole slipped on and around the valve end of the flexible tube such that the flexible tube is tightly fixed through the valve-fixing hole; and a rigid tube sleeved around the flexible tube and having a top end connected to the valve assembly;

a bottom end extending toward the bottom of the can body;

wherein the weight end of the flexible tube protrudes from the bottom end of the rigid tube;

the flexible tube has an exposed section protruding from the bottom end of the rigid tube; the exposed section is located between the bottom end of the rigid tube and a top of the weight piece.

* * * * *